US007364161B2

(12) United States Patent
Lo

(10) Patent No.: US 7,364,161 B2
(45) **Date of Patent: *Apr. 29, 2008**

(54) CARD GAME

(76) Inventor: Henry Tien Lo, 5010 Indian River Dr., #32, Las Vegas, NV (US) 89103

( * ) Notice: Subject to any disclaimer, the term of this patent is extended or adjusted under 35 U.S.C. 154(b) by 0 days.

This patent is subject to a terminal disclaimer.

(21) Appl. No.: 10/859,562

(22) Filed: Sep. 1, 2004

(65) Prior Publication Data

US 2005/0001378 A1 Jan. 6, 2005

Related U.S. Application Data

(63) Continuation-in-part of application No. 10/431,044, filed on May 6, 2003, now Pat. No. 7,004,467, which is a continuation-in-part of application No. 09/823,569, filed on Mar. 29, 2001, now Pat. No. 6,575,465, which is a continuation-in-part of application No. 09/315,295, filed on May 20, 1999, now Pat. No. 6,402,147.

(60) Provisional application No. 60/474,647, filed on May 3, 2003, provisional application No. 60/488,322, filed on Jul. 18, 2003.

(51) Int. Cl.
*A63F 1/00* (2006.01)

(52) U.S. Cl. ..... 273/292; 273/274

(58) Field of Classification Search ..... 273/292, 273/274

See application file for complete search history.

(56) References Cited

U.S. PATENT DOCUMENTS

| | | | | |
|---|---|---|---|---|
| 4,863,042 | A * | 9/1989 | Rohner | 211/11 |
| 5,984,310 | A * | 11/1999 | English | 372/292 |
| 6,019,374 | A * | 2/2000 | Breeding | 273/292 |
| 6,102,402 | A * | 8/2000 | Scott et al. | 273/292 |
| 6,402,147 | B1 * | 6/2002 | Lo | 273/292 |
| 6,443,455 | B1 * | 9/2002 | Webb | 273/274 |
| 6,575,465 | B2 * | 6/2003 | Lo | 273/292 |
| 6,644,666 | B1 * | 11/2003 | Tamura et al. | 273/292 |
| 6,809,076 | B2 * | 10/2004 | Scherhag et al. | 514/4 |
| 7,004,467 | B2 * | 2/2006 | Lo | 273/292 |

* cited by examiner

*Primary Examiner*—Stephen Blau
*Assistant Examiner*—Dolores R. Collins
(74) *Attorney, Agent, or Firm*—Gerry J. Elman; Elman Technology Law, P.C.

(57) ABSTRACT

This invention is mainly a 7-card stud poker game, played with at least one standard poker deck of 52 cards, plus at least one Joker. After a player places a Poker wager and/or a Pair Of Aces Or Better wager, the player then has the option to place a Bonus wager, against a banker. Each said wager automatically wins if the player is dealt a 7-Card 9 High hand or a 7-Card Straight Flush; otherwise, the player's Poker wager wins if the player's best 5-card poker hand ranks higher than or the same as the banker's best 5-card poker hand; the player's Pair Of Aces Or Better wager wins if the player's best 5-card poker hand is a pair of Aces or better; the player's Bonus wager wins if the player's best 5-card poker hand ranks higher than or the same as the banker's with a predetermined hand or better.

20 Claims, 2 Drawing Sheets

CARD GAME

CROSS REFERENCE TO RELATED APPLICATION

This application is a continuation-in-part of application Ser. No. 10/431,044 filed May. 6, 2003 now U.S. Pat. No. 7,004,467, which is a continuation-in-part of application Ser. No. 09/823,569, filed Mar. 29, 2001 now U.S. Pat. No. 6,575,465, which is a continuation-in-part of application Ser. No. 09/315,295, filed May 20, 1999, now U.S. Pat. No. 6,402,147 B1, and claims the benefits under 35 U.S.C. § 119(e) from the following provisional patent applications: Ser. Nos. 60/474,647, filed May 03, 2003; 60/488,322, filed Jul. 18, 2003.

SUMMARY OF THE INVENTION

The present invention generally relates to card games and, in particular, to card games for use in casinos and cardrooms.

Pai Gow Poker, a seven-card stud poker game, is getting more and more popular in casinos across the country every day. Players who loves Pai Gow Poker found the game is simple enough and provides them seven cards for reading enjoyment as well as relaxation. Yet, many players are disgruntled with its adverse features—collecting 5% commission of all winning wagers and the copy-hand rules in which the Banker wins all same ranking hands; while some casinos find the game too slow, not profitable. Commonly owned U.S. patent application Ser. No. 09/823,569 and U.S. Pat. No. 6,402,147 B1 to Lo are invented to overcome these disadvantages of Pai Gow Poker. Besides eliminating both 5% commission thing and the copy-hand rules, they simplifies the dealing procedure and the rules of play of Pai Gow Poker. However, two said games offers players an excessive number of bets, which could confuse the players every time they make a betting decision, but not enough choices in settling wagers of the primary bets to meet the particular need of each casino. The present invention is devised to solve these problems.

SUMMARY OF THE INVENTION

The present invention is a seven-card-stub poker game, played with at least one standard poker deck of 52 cards plus at least one 'Joker.' The Joker either is 'semi-wild' and can be used as an Ace or to form a Straight or Flush, or is 'wild' and can be used as any card. In the present invention, the Joker is preferably 'semi-wild.' Two or more players, preferably seven players, may participate in the game. One of the players is the Banker whom other players play against. A Player who is not a Banker may make a Poker Bet wager playing against the Banker's hand and/or a Pair Of Aces Or Better Bet wager; after at least one of two said wagers is placed, the Player has an option to make a Bonus Bet wager.

Once at least one wager is placed, every Player and the Banker are each dealt seven cards. From each Player's seven cards, each Player selects and keeps his or her best 5-card poker hand (the Player's hand) and discards two other cards. From the Banker's seven cards, the Banker selects and keeps the Banker's best 5-card poker hand (the Banker's hand) and discards two other cards.

POKER BET: Poker Bet is a bet that allows a Player to place a wager playing against a Banker's hand. The object of Poker bet is to have a best 5-card poker hand that ranks the same or ranks higher than the opponent's best 5-card poker hand. In the Poker Bet game, a Player's hand is compared to the Banker's hand according to the following rankings wherein hands are ranked in descending order as follows: 5 Ace, Royal Flush, Straight Flush, 4 of a Kind, Full House, Flush, Straight, 3 of a Kind, Two Pair, One Pair and High Card; wherein A2345 is the second highest Straight and that it is suited, A2345 is the second highest Straight Flush.

A Poker Bet wager may be settled according to any one of the following sets of rules:

If the Player's best 5-card poker hand ranks the same as or ranks higher than the Banker's best 5-card poker hand, the Player's wager wins and, either is paid Even Money, 1 to 1, if the Banker's losing hand is a hand of King-Queen or better or is paid one half of the wager (1 to 2) if the Banker's hand is a hand of King-Jack or lower; if the Player's best 5-card poker hand ranks lower than the Banker, the Player's wager loses.

If the Banker's hand (best 5-card poker hand) is not a qualifying hand of Ace-high or better (i.e. a hand consisting of A8765 is an Ace-high hand, and a hand consisting of 55KQJ is a better hand than the Ace-high hand), the Player's wager wins and is paid one half of the wager (1 to 2) even the Player's hand (best 5-card poker hand) ranks lower than the Banker's; if the Player's hand ranks lower than the Banker's and the Banker's hand is a qualifying hand of Ace-high or better, the Player's wager loses; if the Player's hand ranks higher than or ranks the same as the Banker's and the Banker's hand is a qualifying hand of Ace-high or better, the Player's wager wins and is paid Even Money (1 to 1).

If the Banker's hand is not one of the predetermined qualifying hands, the Player's wager wins and is paid one half of the wager (1 to 2) even the Player's hand ranks lower than the Banker's; if the Player's hand ranks lower than the Banker's and the Banker's hand is one of the predetermined qualifying hands, the Player's wager loses; if the Player's hand ranks higher than or ranks the same as the Banker's and the Banker's hand is one of the predetermined qualifying hands, the Player's wager wins and is paid according to a predetermined pay table. Banker's with a pair of Kings or lower.

PAIR OF ACES OR BETTER BET: A Player's Pair Of Aces Or Better Bet wager wins if the Player is dealt a 7 Card 9 High hand (i.e., a hand consists of 9, 8, 7, 6, 4, 3 and 2, or consists of 9, 8, 7, 5, 4, 3 and 2) a 7 Card Straight Flush hand), or if the Player's hand is a pair of Aces, Two Pair, 3 of a Kind, Straight, Flush, Full House, 4 of a Kind, Straight Flush, Royal Flush or 5 Aces; and the Player's wager loses if the Player's hand is not one of the above winning hands. The player's winning wager may be paid according to one of the predetermined pay tables below:

PAY TABLE 1

| Hand | Payout Odds |
|---|---|
| Two Pair Or Better | 1 to 1 |
| Two Or More Aces | 3 to 2 |
| 7 Card 9 High | 1 to 1 |

PAY TABLE 2

| Hand | Payout Odds |
|---|---|
| 5 Aces | 50 to 1 |
| Royal Flush | 20 to 1 |
| Straight Flush | 7 to 1 |
| 4 of a Kind | 6 to 1 |

PAY TABLE 2-continued

| Hand | Payout Odds |
|---|---|
| Full House | 2 to 1 |
| Aces through Flush | 1 to 1 |
| 7 Card 9 High | 1 to 1 |

BONUS BET: Below are three main versions of the Bonus Bet:

3 Of A Kind Or Better Version: A Player's Bonus Bet wager wins if the Player is dealt a 7 Card 9 High hand or a 7 Card Straight Flush hand, or if the Player's hand ranks the same as or ranks higher than the Banker's with 3 of a Kind, Straight, Flush, Full House, 4 of a Kind, Straight Flush, Royal Flush or 5 Aces; the Player's Bonus Bet wager is a push and neither wins nor loses if the Player's hand ranks lower than the Banker's with Flush or better; and the Player's wager loses if the Player's hand is not one of said winning hands; and the Player's winning wager is paid as follows:

| Hand | Payout Odds |
|---|---|
| 7 Card Straight Flush With No Joker | 10,000 to 1 |
| 7 Card Straight Flush With Joker | 3,000 to 1 |
| 5 Aces | 1,000 to 1 |
| Royal Flush | 400 to 1 |
| Wild Royal Flush | 200 to 1 |
| Straight Flush | 75 to 1 |
| 4 of a Kind | 50 to 1 |
| Full House | 6 to 1 |
| Flush | 3 to 1 |
| Straight | 2 to 1 |
| 3 Of A Kind | 2 to 1 |
| 7 Card 9 High | 10 to 1 |

Straight Or Better Version: A Player's Bonus Bet wager wins if the Player is dealt a 7 Card 9 High hand or a 7 Card Straight Flush hand, or if the Player's hand ranks the same as or ranks higher than the Banker's with Straight, Flush, Full House, 4 of a Kind, Straight Flush, Royal Flush or 5 Aces; the Player's wager is a push and neither wins nor loses if the Player is not dealt a 7 Card 9 High hand or a 7 Card Straight Flush, and the Player's hand ranks lower than the Banker's with Straight or better; and the Player's wager loses if the Player is not dealt a 7 Card 9 High hand or a 7 Card Straight Flush, and the Player's hand is 3 of a Kind or lower; and the Player's winning wager is paid as follows:

| Hand | Payout Odds |
|---|---|
| 7 Card Straight Flush With No Joker | 10,000 to 1 |
| 7 Card Straight Flush With Joker | 5,000 to 1 |
| 5 Aces | 2,000 to 1 |
| Royal Flush | 500 to 1 |
| Wild Royal Flush | 200 to 1 |
| Straight Flush | 100 to 1 |
| 4 of a Kind | 50 to 1 |
| Full House | 6 to 1 |
| Flush | 4 to 1 |
| Straight | 2 to 1 |
| 7 Card 9 High | 10 to 1 |

Flush Or Better Version: A Player's Bonus Bet wager wins if the Player is dealt a 7 Card 9 High hand or a 7 Card Straight Flush hand, or if the Player's hand ranks the same as or ranks higher than the Banker's with Flush, Full House, 4 of a Kind, Straight Flush, Royal Flush or 5 Aces; the Player's wager is a push and neither wins nor loses if the Player is not dealt a 7 Card 9 High hand or a 7 Card Straight Flush, and the Player's hand ranks lower than the Banker's with Flush or better; and the Player's wager loses if the Player is not dealt a 7 Card 9 High hand or a 7 Card Straight Flush, and the Player's hand is Straight or lower; and the Player's winning wager is paid as follows:

| Hand | Payout Odds |
|---|---|
| 7 Card Straight Flush With No Joker | 20,000 to 1 |
| 7 Card Straight Flush With Joker | 10,000 to 1 |
| 5 Aces | 3,000 to 1 |
| Royal Flush | 800 to 1 |
| Wild Royal Flush | 500 to 1 |
| Straight Flush | 150 to 1 |
| 4 of a Kind | 75 to 1 |
| Full House | 6 to 1 |
| Flush | 3 to 1 |
| 7 Card 9 High | 10 to 1 |

After reading their cards, each Player places his or her cards face up on the appropriate spaces of the table layout. The dealer then reveals the Banker's six remaining cards, selects and keeps the Banker's best 5-card poker hand and discards two other cards, and settles each Player's Pair Of Aces Or Better Bet wager first if any, then each Player's Poker Bet wager if any, and each Player's Bonus Bet wager last if any, against the Banker.

The objective of the present invention is to provide players a thrilling, enjoyable and relaxing gaming experience, while giving casinos a fair return on investment.

It is an advantage of the present invention that it reduces an excessive number of side bets the co-pending application Ser. No. 09/823,569 offers from 6 to 2, while enhancing the appeal of the payout of two said side bets.

It is also an advantage of the present invention that it features two Even-Money-Payout games designed to enable players winning more often and having more fun, and one Jackpot-Payout game designed to enable players betting a little and being able to win a bundle.

It is another advantage of the present invention that it balances the house advantage—great enough to give a casino a fair return on investment while no so large to give players the sense of winning.

It is a feature of the present invention that it provides casinos a great number of sets of rules to choose from and to meets their particular need.

It is also a feature of the present invention that it offers players seven cards for reading enjoyment.

It is another feature of the present invention that It is a rapid-wager-resolution game.

It is also another feature of the present invention that it gives most of the players who have played it truly a thrilling, enjoyable, and relaxing experience due to the advantages and features mentioned above.

Other advantages and features of the present invention will be apparent from the detailed description of the invention, the accompanying drawings and the appended claims.

DETAILED DESCRIPTION OF THE INVENTION

Figure 1:
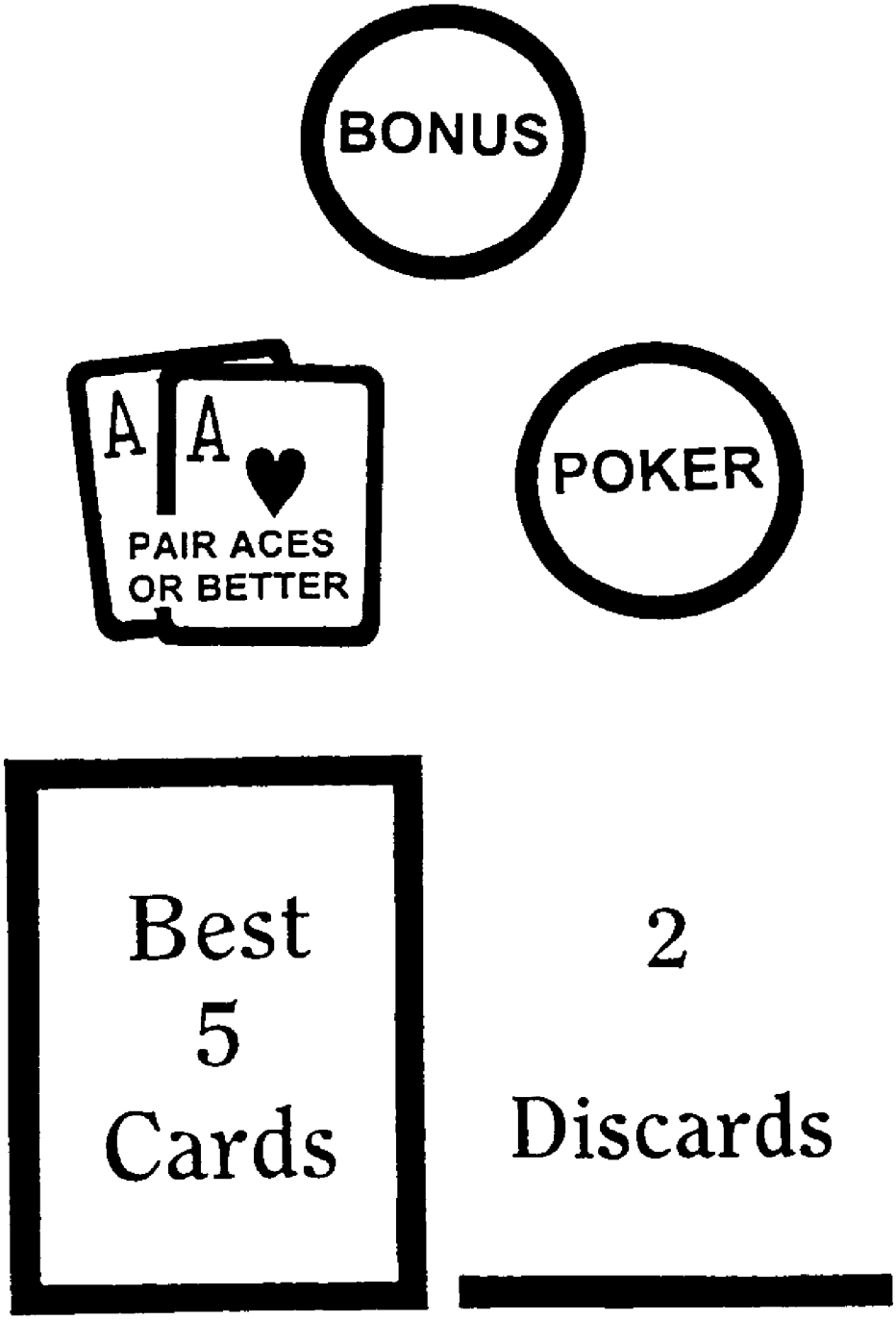
FIG. 1 shows a Player's betting area of the table layout of the present invention: The double squares marked 'Pair Aces Or Better' is a Pair Of Aces Or Better Bet spot; the circle marked 'Bonus' is a Bonus Bet spot; the circle marked 'Poker' is a Poker Bet spot; the big square marked 'Best 5 Cards' is a Player's best 5-card poker hand space; and the area marked '2 Discards' is a Player's two discards space.
Figure 2:
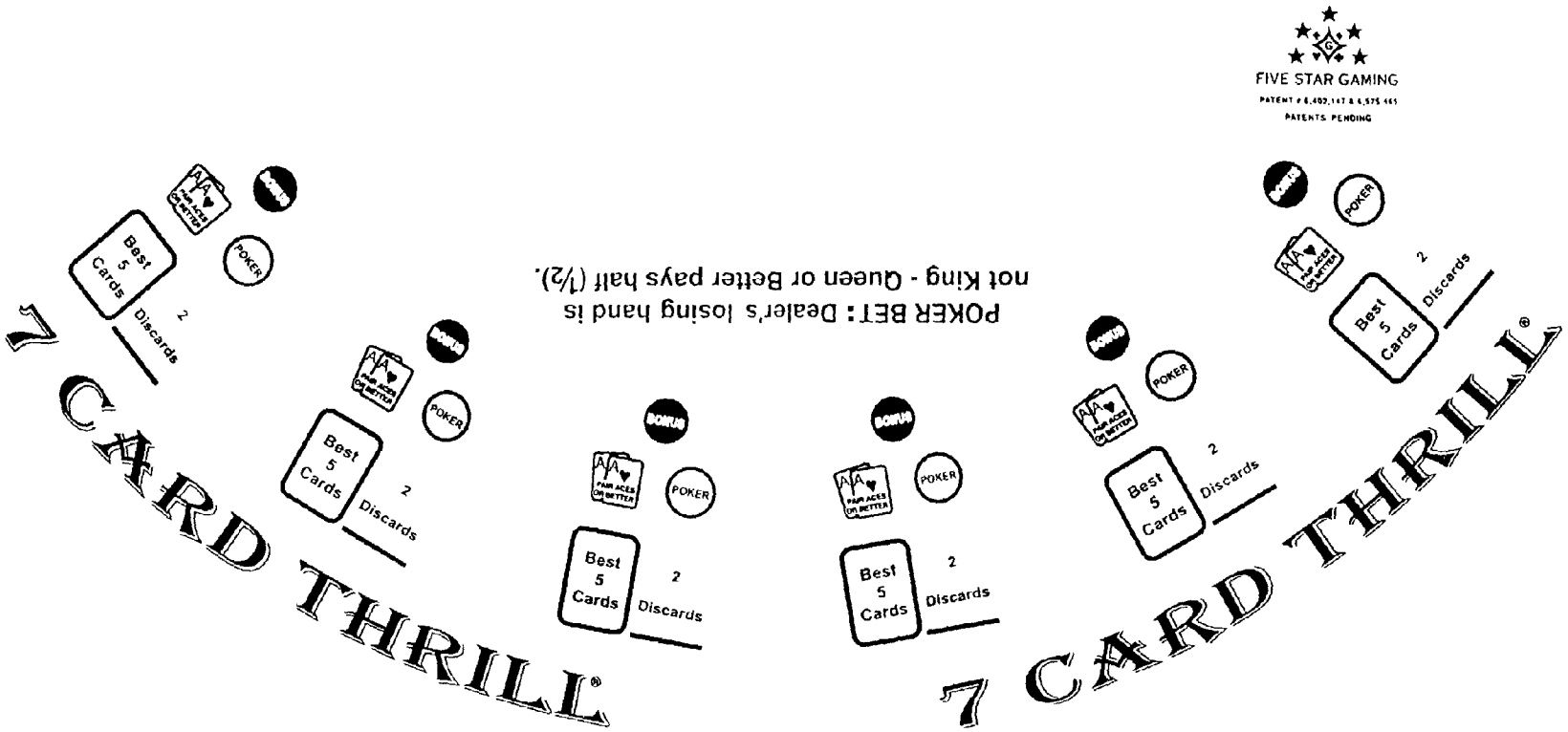
FIG. 2 shows the table layout of the joker-semi-wild version of the present invention, called "7 Card Thrill".

In the preferred embodiment of the invention is a seven-card stud poker game, played with one standard poker deck of 52 cards plus one Joker. Other embodiments include versions that would be played with at least one standard poker deck of 52 cards plus at least one Joker. In another thirteen embodiments, the invention is played with at least one standard poker deck of 52 cards, wherein either all Twos, all Threes, all Fours, all Fives, all Sixes, all Sevens, all Eights, all Nines, all Tens, all Jacks, all Queens, all Kings, or all Aces are Wild Cards. In an embodiment, the invention is played with at least one standard poker deck of 52 cards.

In the preferred embodiment, each Joker or each Wild Card can be used as an Ace, or to form a Straight or Flush. In an embodiment, each Joker or each Wild Card can be used as any card.

In the preferred embodiment, the present invention offers seven positions, six Players and one Banker; table size, management of players, players' bets, and speed of play are the key reasons for the choice of seven positions. In other embodiments, lesser or greater than seven positions can be created in accordance with this invention if, for example, multiple decks are used. A Player who is not a Banker may place a Poker Bet wager playing against the Banker's hand and/or Pair Of Aces Or Better Bet wager; after at least one of two said wagers is placed, the Player has an option to place a Bonus Bet wager.

After at least one wager is placed, each Player and the Banker are each dealt seven cards. In the preferred embodiment, every Player and the Banker each receives his or her own seven-card dealt hand either at one time or proportionally, starting from the Player sitting to the immediate left of the dealer, continuing in a clockwise fashion and ending with the Banker; cards are preferably dealt to each Player and to the Banker one card at a time for seven times if the cards are shuffled by a dealer; and the cards are preferably dealt to each Player and to the Banker in a stack of seven cards if the cards are shuffled by a shuffling device. In an embodiment, seven or eight hands of seven cards are always dealt, regardless of the actual number of players; and some random number generation device such as a random number generator display or a dice shaker, is used to assign the dealt hands to players to reduce the likelihood of problems in dealing. In other embodiments, every Player and the Banker will receive their hand in either one of the following fashions:

1. They receive their own six cards and one community card.
2. They receive their own five cards and two community cards.
3. They receive their own four cards and three community cards.
4. They receive their own three cards and four community cards.
5. They receive their own two cards and five community cards.
6. They receive their own one card and six community cards. And
7. They receive no card their own and seven community cards.

Once the dealer has delivered the cards to all players, the dealer turns over the Banker's seven cards with only the top card exposed. Each Player selects and keeps his or her hand (the Player's hand), discards two other cards, and then places the cards either face up or face down on the appropriate spaces of the table layout. The dealer then reveals the Banker's six remaining cards, selects and keeps the Banker's best 5-card poker hand (the Banker's hand) discards two other cards, opens the cards of the Player at the immediate right of the dealer, and settles the Player's Pair Of Aces Or Better Bet wager first if any, then the Player's Poker Bet wager if any, and the Player's Bonus Bet wager last if any, against the Banker. After completing the transaction of the Player at the immediate right of the dealer, the dealer moves on and completes the transaction of the next Player, and so on. Upon the completion of all transactions, a new round of play will begin.

POKER BET: Poker Bet is a bet that allows a Player to place a wager playing against a Banker's hand. Mainly, the object of Poker bet is to have a best 5-card poker hand that ranks the same as or ranks higher than the Banker's best 5-card poker hand. In the Poker Bet game, a Player's hand is compared to the Banker's hand according to the rankings wherein hands are ranked in descending order as follows: 5 Ace, Royal Flush, Straight Flush, 4 of a Kind, Full House, Flush, Straight, 3 of a Kind, Two Pair, One Pair and High Card; wherein A2345 is the second highest Straight, and when it is suited, A2345 is the second highest Straight Flush. If chosen, A2345 is the lowest Straight, and when it is suited, A2345 is the lowest Straight Flush A Poker Bet wager may be settled according to any one of the following sets of rules:

Rules 1: If the Player is dealt a 7 Card 9 High hand or a 7 Card Straight Flush hand, or if the Player's best 5-card poker hand ranks the same as or ranks higher than the Banker's best 5-card poker hand, the Player's Poker Bet wager wins and, either is paid Even Money (1 to 1), if the Banker's losing hand is a hand of King-Queen or better, or is paid one half of the wager (1 to 2) if the Player is not dealt a 7 Card 9 High hand or a 7 Card Straight Flush hand, and if the Player's best 5-card poker hand ranks lower than the Banker's, the Player's wager loses.

Rules 2: If the Player is dealt a 7 Card 9 High hand or a 7 Card Straight Flush hand, or if the Player's best 5-card poker hand ranks the same as or ranks higher than the Banker's best 5-card poker hand, the Player's wager wins and, either is paid Even Money (1 to 1), if the Banker's losing hand is a predetermined rank or better or is paid one half of the wager (1 to 2) if the Banker's hand is not a predetermined rank or better; if the Player is not dealt a 7 Card 9 High hand or a 7 Card Straight Flush hand, and the Player's best 5-card poker hand ranks lower than the Banker's, the Player's wager loses.

Rules 3: If the Player is not dealt a 7 Card 9 High hand or a 7 Card Straight Flush hand, or if the Player's best 5-card poker hand ranks the same as or ranks higher than the Banker's best 5-card poker hand, the Player's wager wins and is paid Even Money (1 to 1), less a predetermined percent commission; if the Player is not dealt a 7 Card 9 High hand or a 7 Card Straight Flush hand, and the Player's best 5-card poker hand ranks lower than the Banker's, the Player's wager loses.

Rules 4: If the Player is dealt a 7 Card 9 High hand or a 7 Card Straight Flush hand, or if the Player's hand ranks the same as or ranks higher than the Banker's hand, the Player's wager wins and is paid Even Money (1 to 1), less a five percent commission; if the Player is not dealt a 7 Card 9 High hand or a 7 Card Straight Flush hand, and the Player's hand ranks lower than the Banker's, the Player's wager loses.

Rules 5: If the Player is dealt a 7 Card 9 High hand or a 7 Card Straight Flush hand, or if the Player is dealt a 7 Card 9 High hand or a 7 Card Straight Flush hand, or if the Player's hand ranks the same as or ranks higher than the Banker's hand, the Player's wager wins and, either is paid Even Money (1 to 1), if the Banker's losing hand is a predetermined hand or better or is paid one half of the wager (1 to 2) if the Banker's hand is not a predetermined hand or better; if the Player is not dealt a 7 Card 9 High hand or a 7 Card Straight Flush hand, and the Player's hand ranks lower than the Banker's, the Player's wager loses.

Rules 6: If the Player is dealt a 7 Card 9 High hand or a 7 Card Straight Flush hand, or if the Player's hand ranks the same as or ranks higher than the Banker's hand, the Player's wager wins and, is paid either according to a predetermined payout odds or a predetermined pay table if the Banker's losing hand is a predetermined hand or better, or is paid one half of the wager (1 to 2) if the Banker's hand is not a predetermined hand or better; if the Player is not dealt a 7 Card 9 High hand or a 7 Card Straight Flush hand, and the Player's hand ranks lower than the Banker's, the Player's wager loses.

Rules 7: If the Player is not dealt a 7 Card 9 High hand or a 7 Card Straight Flush hand and the Banker's hand is not a qualifying hand of Ace-high or better (i.e. a hand consisting of A8765 is an Ace-high hand, and a hand consisting of 55KQJ is a better hand than the Ace-high hand), the Player's wager wins and is paid one half of the wager (1 to 2) even the Player's hand ranks lower than the Banker's; if the Player is not dealt a 7 Card 9 High hand or a 7 Card Straight Flush hand, and the Player's hand ranks lower than the Banker's and the Banker's hand is a qualifying hand of Ace-high or better, the Player's wager loses; if the Player is dealt a 7 Card 9 High hand or a 7 Card Straight Flush hand, and the Player's hand ranks higher than or ranks the same as the Banker's and the Banker's hand is a qualifying hand of Ace-high or better, the Player's wager wins and is paid Even Money (1 to 1).

Rules 8: If the Player is not dealt a 7 Card 9 High hand or a 7 Card Straight Flush hand and the Banker's hand is not one of the predetermined qualifying hands, the Player's wager wins and is paid one half of the wager (1 to 2) even the Player's hand ranks lower than the Banker's; if the Player is not dealt a 7 Card 9 High hand or a 7 Card Straight Flush, and the Player's hand ranks lower than the Banker's and the Banker's hand is one of the predetermined qualifying hands, the Player's wager loses; if the Player is dealt a 7 Card 9 High hand or a 7 Card Straight Flush hand, or if the Player's hand ranks higher than or ranks the same as the Banker's and the Banker's hand is one of the predetermined qualifying hands, the Player's wager wins and can be paid according to either a predetermined pay table or a predetermined payoff odds.

PAIR OF ACES OR BETTER BET: There are two versions of Pair Of Aces Or Better Bet and they are:

Version I: A Player's Pair Of Aces Or Better Bet wager wins if the Player is dealt a 7 Card 9 High hand (i.e., a hand consists of 9, 8, 7, 6, 4, 3 and 2, or consists of 9, 8, 7, 5, 4, 3 and 2) a 7 Card Straight Flush hand, or if the Player's hand is a pair of Aces, Two Pair, 3 of a Kind, Straight, Flush, Full House, 4 of a Kind, Straight Flush, Royal Flush or 5 Aces; and the Player's wager loses if the Player's hand is not one of the above winning hands. The player's winning wager may be paid according to one of the following pay tables below:

PAY TABLE 1

| Hand | Payout Odds |
|---|---|
| Two Pair Or Better | 1 to 1 |
| Two Or More Aces | 3 to 2 |
| 7 Card 9 High | 1 to 1 |

PAY TABLE 2

| Hand | Payout Odds |
|---|---|
| 7 Card Straight Flush with No Joker | 200 to 1 |
| 7 Card Straight Flush with Joker | 100 to 1 |
| 5 Aces | 50 to 1 |
| Royal Flush | 20 to 1 |
| Straight Flush | 7 to 1 |
| 4 of a Kind | 6 to 1 |
| Full House | 2 to 1 |
| Aces through Flush | 1 to 1 |
| 7 Card 9 High | 1 to 1 |

Version II: A Player's Pair Of Aces Or Better Bet wager wins if the Player is dealt a 7 Card 9 High hand (i.e., a hand consists of 9, 8, 7, 6, 4, 3 and 2, or consists of 9, 8, 7, 5, 4, 3 and 2) a 7 Card Straight Flush hand or a 7 Card Straight Flush, or if the Player's hand ranks the same as or ranks higher than the Banker's hand with a pair of Aces, Two Pair, 3 of a Kind, Straight, Flush, Full House, 4 of a Kind, Straight Flush, Royal Flush or 5 Aces; and the Player's wager loses if the Player is not is dealt a 7 Card 9 High hand or a 7 Card Straight Flush, and the Player's hand ranks lower than the Banker's hand with a pair of Aces or better, or if the Player is not is dealt a 7 Card 9 High hand or a 7 Card Straight Flush, and the Player's hand is not a pair of Kings or lower; and the Player's winning wager can be paid either a predetermined payoff odds or a predetermined pay table, whichever is chosen.

BONUS BET: One of the following versions of games can be selected to be the Bonus Bet of the present invention:

3 Of A Kind Or Better Version: There are two types of 3 Of A Kind Or Better Version and they are:

Type 1: A Player's Bonus Bet wager wins if the Player is dealt a 7 Card 9 High hand or a 7 Card Straight Flush, or if the Player's hand ranks the same as or ranks higher than the Banker's hand with 3 of a Kind or better (Straight, Flush, Full House, 4 of a Kind, Straight Flush, Royal Flush or 5 Aces); the Player's wager is a push and neither wins nor loses if the Player is not dealt a 7 Card 9 High hand or a 7 Card Straight Flush, and the Player's hand ranks lower than the Banker's with Flush or better; and the Player's wager loses if the Player is not dealt a 7 Card 9 High hand or a 7 Card Straight Flush, and the Player's hand is Two Pair or lower; and the Player's winning wager is paid as follows:

| Hand | Payout Odds |
|---|---|
| 7 Card Straight Flush With No Joker | 10,000 to 1 |
| 7 Card Straight Flush With Joker | 3,000 to 1 |
| 5 Aces | 1,000 to 1 |
| Royal Flush | 400 to 1 |
| Wild Royal Flush | 200 to 1 |
| Straight Flush | 75 to 1 |

-continued

| Hand | Payout Odds |
|---|---|
| 4 of a Kind | 40 to 1 |
| Full House | 6 to 1 |
| Flush | 3 to 1 |
| Straight | 2 to 1 |
| 3 Of A Kind | 2 to 1 |
| 7 Card 9 High | 10 to 1 |

Alternatively, the winning wager of type 1 of 3 Of A Kind Or Better Version of Bonus Bet can also be paid according to either a predetermined payoff odds or a predetermined pay table. Optionally, the pay table of this version of Bonus Bet can be subject to a predetermined maximum payout per Bonus Bet wager or per whole table (the predetermined maximum payout is shared by all Bonus Bet winners on the same table in any given round of play) if selected; such predetermined maximum payout can be $25,000, $50,000, $100,000, $200,000, or other predetermined maximum payout.

Type 2: A Player's Bonus Bet wager wins if the Player is dealt a 7 Card 9 High hand or a 7 Card Straight Flush, or if the Player's hand ranks higher than the Banker's hand with 3 of a Kind or better (Straight, Flush, Full House, 4 of a Kind, Straight Flush, Royal Flush or 5 Aces); the Player's wager loses if the Player is not dealt a 7 Card 9 High hand or a 7 Card Straight Flush and the Player's hand ranks lower than or ranks the same as the Banker's, or if the Player is not dealt a 7 Card 9 High hand or a 7 Card Straight Flush and the Player's hand is Two Pair or lower,; and the Player's winning wager is paid as follows:

| Hand | Payout Odds |
|---|---|
| 7 Card Straight Flush With No Joker | 10,000 to 1 |
| 7 Card Straight Flush With Joker | 3,000 to 1 |
| 5 Aces | 1,000 to 1 |
| Royal Flush | 400 to 1 |
| Wild Royal Flush | 200 to 1 |
| Straight Flush | 75 to 1 |
| 4 of a Kind | 50 to 1 |
| Full House | 6 to 1 |
| Flush | 3 to 1 |
| Straight | 2 to 1 |
| 3 Of A Kind | 2 to 1 |
| 7 Card 9 High | 10 to 1 |

The winning wager of type 2 of 3 Of A Kind Or Better Version of Bonus Bet can also be paid according to either a predetermined payoff odds or a predetermined pay table. Optionally, the pay table of this version of Bonus Bet can be subject to a predetermined maximum payout per Bonus Bet or per whole table (the predetermined maximum payout is shared by all Bonus Bet winners in any given round of play) if selected; such predetermined maximum payout can be $25,000, $50,000, $100,000, $200,000, or other appropriate predetermined maximum payout.

Straight Or Better Version: There are two types of Straight Or Better Version and they are:

Type 1: A Player's Bonus Bet wager wins if the Player is dealt a 7 Card 9 High hand or a 7 Card Straight Flush, or if the Player's hand ranks the same as or ranks higher than the Banker's with Straight or better (Flush, Full House, 4 of a Kind, Straight Flush, Royal Flush or 5 Aces); the Player's wager is a push and neither wins nor loses if the Player is not dealt a 7 Card 9 High hand or a 7 Card Straight Flush, and the Player's hand ranks lower than the Banker's with Straight or better; and the Player's wager loses if the Player is not dealt a 7 Card 9 High hand or a 7 Card Straight Flush, and the Player's hand is 3 of a Kind or lower; and the Player's winning wager is paid as follows:

| Hand | Payout Odds |
|---|---|
| 7 Card Straight Flush With No Joker | 10,000 to 1 |
| 7 Card Straight Flush With Joker | 5,000 to 1 |
| 5 Aces | 2,000 to 1 |
| Royal Flush | 500 to 1 |
| Wild Royal Flush | 200 to 1 |
| Straight Flush | 100 to 1 |
| 4 of a Kind | 50 to 1 |
| Full House | 6 to 1 |
| Flush | 4 to 1 |
| Straight | 2 to 1 |
| 7 Card 9 High | 10 to 1 |

The winning wager of type 1 of Straight Or Better Version of Bonus Bet can also be paid according to a predetermined payoff odds or a predetermined pay table. Optionally, the pay table of this version of Bonus Bet can be subject to a predetermined maximum payout per Bonus Bet or per whole table (the predetermined maximum payout is shared by all Bonus Bet winners in any given round of play) if selected; such predetermined maximum payout can be $25,000, $50,000, $100,000, $200,000 or other appropriate predetermined maximum payout.

Type 2: A Player's Bonus Bet wager wins if the Player is dealt a 7 Card 9 High hand or a 7 Card Straight Flush, or if the Player's hand ranks higher than the Banker's with Straight or better (Flush, Full House, 4 of a Kind, Straight Flush, Royal Flush or 5 Aces); the Player's wager loses if the Player is not dealt a 7 Card 9 High hand or a 7 Card Straight Flush, and the Player's hand ranks lower than or ranks the same as the Banker's with Straight or better, or if the Player is not dealt a 7 Card 9 High hand or a 7 Card Straight Flush, and the Player's hand is 3 of a Kind or lower; and the Player's winning wager is paid as follows:

| Hand | Payout Odds |
|---|---|
| 7 Card Straight Flush With No Joker | 10,000 to 1 |
| 7 Card Straight Flush With Joker | 5,000 to 1 |
| 5 Aces | 2,000 to 1 |
| Royal Flush | 500 to 1 |
| Wild Royal Flush | 200 to 1 |
| Straight Flush | 100 to 1 |
| 4 of a Kind | 50 to 1 |
| Full House | 6 to 1 |
| Flush | 4 to 1 |
| Straight | 2 to 1 |
| 7 Card 9 High | 10 to 1 |

The winning wager of type 2 of Straight Or Better Version of Bonus Bet can also be paid according to either a predetermined payoff odds or a predetermined pay table. Optionally, the pay table of this version of Bonus Bet can be subject to a predetermined maximum payout per Bonus Bet or per whole table (the predetermined maximum payout is shared by all Bonus Bet winners in any given round of play) if selected; such predetermined maximum payout can be $25,000, $50,000, $100,000, $200,000 or other predetermined maximum payout.

Flush Or Better Version: There are two types of Flush Or Better Versions and they are:

Type 1: A Player's Bonus Bet wager wins if the Player is dealt a 7 Card 9 High hand or a 7 Card Straight Flush, or if the Player's hand ranks the same as or ranks higher than the Banker's hand with Flush or better (Full House, 4 of a Kind, Straight Flush, Royal Flush or 5 Aces); the Player's wager is a push and neither wins nor loses if the Player is not dealt a 7 Card 9 High hand or a 7 Card Straight Flush, and the Player's hand ranks lower than the Banker's with Flush or better; the Player's wager loses if the Player is not dealt a 7 Card 9 High hand or a 7 Card Straight Flush, and the Player's hand is Straight or lower; and the Player's winning wager is paid as follows:

| Hand | Payout Odds |
|---|---|
| 7 Card Straight Flush With No Joker | 20,000 to 1 |
| 7 Card Straight Flush With Joker | 10,000 to 1 |
| 5 Aces | 3,000 to 1 |
| Royal Flush | 800 to 1 |
| Wild Royal Flush | 500 to 1 |
| Straight Flush | 150 to 1 |
| 4 of a Kind | 75 to 1 |
| Full House | 6 to 1 |
| Flush | 3 to 1 |
| 7 Card 9 High | 10 to 1 |

The winning wager of type 1 of Flush Or Better Version of Bonus Bet can also be paid according to either a predetermined payoff odds or a predetermined pay table. Optionally, the pay table of this version of Bonus Bet can be subject to a predetermined maximum payout per Bonus bet or per whole table (the predetermined maximum payout is shared by all Bonus Bet winners in any given round of play) if selected; such predetermined maximum payout can be $25,000, $50,000, $100,000, $200,000 or other predetermined maximum payout.

Type 2: A Player's Bonus Bet wager wins if the Player is dealt a 7 Card 9 High hand or a 7 Card Straight Flush, or if the Player's hand ranks the same as or ranks higher than the Banker's hand with Flush or better (Full House, 4 of a Kind, Straight Flush, Royal Flush or 5 Aces); the Player's wager loses if the Player is not dealt a 7 Card 9 High hand or a 7 Card Straight Flush, and the Player's hand ranks lower than or ranks the same as the Banker's with Flush or better, or if the Player is not dealt a 7 Card 9 High hand or a 7 Card Straight Flush, and the Player's hand is Straight or lower; and the Player's winning wager is paid as follows:

| Hand | Payout Odds |
|---|---|
| 7 Card Straight Flush With No Joker | 20,000 to 1 |
| 7 Card Straight Flush With Joker | 10,000 to 1 |
| 5 Aces | 3,000 to 1 |
| Royal Flush | 800 to 1 |
| Wild Royal Flush | 500 to 1 |
| Straight Flush | 150 to 1 |
| 4 of a Kind | 75 to 1 |
| Full House | 6 to 1 |
| Flush | 3 to 1 |
| 7 Card 9 High | 10 to 1 |

The winning wager of type 2 of Flush Or Better Version of Bonus Bet can also be paid according to either a predetermined payoff odds or a predetermined pay table. Optionally, the pay table of this version of Bonus Bet can be subject to a predetermined maximum payout per Bonus bet or per whole table (the predetermined maximum payout is shared by all Bonus Bet winners in any given round of play) if selected; such predetermined maximum payout can be $25,000, $50,000, $100,000, $200,000 or other predetermined maximum payout.

After reading their cards, each Player places his or her cards face up on the appropriate spaces of the table layout. The dealer then reveals the Banker's six remaining cards, selects and keeps the Banker's best 5-card poker hand and discards two other cards, and settles each Player's Pair Of Aces Or Better Bet wager first if any, then each Player's Poker Bet wager if any, and each Player's Bonus Bet wager last if any, against the Banker.

OTHER VERSIONS OF THE PRESENT INVENTION: Other versions of the present invention can be created in the following ways:

1. The present invention consists of Poker Bet only.
2. The present invention consists of Pair Of Aces Or Better Bet only.
3. The present invention consists of Bonus Bet only.
4. The present invention consists of Poker Bet and Pair Of Aces Or Better Bet.
5. The present invention consists of Poker Bet and Bonus Bet. And
6. The present invention consists of Pair Of Aces Or Better Bet and Bonus Bet.

Any one, any two, or all three of Bonus Bet, Pair Of Aces Or Better Bet and Bonus Bet can be incorporated into any other seven-card stud poker game or any seven-card draw poker game with or without some adjustments or moderations.

The present invention can be designed to play with various number of cards selected from each seven-dealt-card hand, where the rankings and the value of hands of the game are based on; i.e. the rankings and value hands of the preferred embodiment of the present invention are based the best 5 cards out of each seven-dealt-card hand. Hence, the present invention can be designed to play with the rankings and value hands of the game based on best six cards out of each seven-dealt-card hand, based on seven-card handout of seven dealt cards, or based on best four cards out of seven dealt cards.

Other card games can be created in accordance with the present invention, by applying the rules of play of the present invention or by applying the rules of play of the present invention with minor modifications to any card game that can be played with six cards per hand wherein each player's best 5-card poker hand selected from each player's six dealt cards, eight cards per hand wherein each player's best 5-card poker hand selected from each player's eight cards or, nine or more cards per hand wherein each player's best 5-card poker hand selected from each player's nine or more cards, using at least one standard deck of 52 cards or at least one standard deck of 52 cards plus at least one Joker.

With some modifications, the present invention—a seven-card-stud poker game—can be transformed to be a new 7 card draw poker game, new 8 card draw poker game.

The new 7 card draw poker game and new 8 card draw poker game: Either game can be played with at least one conventional poker deck of 52 cards plus at least one Joker, but preferably one Joker, or at least one conventional poker deck of 52 cards. The Joker can be used as an Ace, or to form a Straight or Flush, and is hereby called 'semi-wild joker;' or the Joker can be used as any card, is hereby called 'wild joker;' either function of the Joker can be chosen to be incorporated into the game.

Two or up to seven players may participate in the game, and one of them is a Banker who other players play against. A Player who is not a Banker may make a Poker Bet wager against the Banker's hand and/or at least one Side Bet wagers. The Side Bet consists of Specified Hand Or Better Bet, Aces Pair Or Better Bet, Two Pair Or Better Bet, 3 Of A Kind Or Better Bet, Straight Or Better Bet, Flush Or Better Bet and Full House Or Better Bet.

Either one of the following ways, whichever is chosen for the new 7 card draw poker game, in which every Player and the Banker receive their cards and select their best 5-card poker hand:

Version 1: After at least one wager of Poker Bet and/or at least one wager of Side Bet is placed, the Banker is dealt seven cards, and each Player is dealt five cards. Each Player then has the option either to keep the whole five dealt cards and draw one card or to discard one card and draw two new cards, and then each Player selects and keeps his or her best 5-card poker hand (hereinafter referred as "the Player's hand") and discards one card from each Player's remaining six cards. The dealer then selects and keeps the Banker's best 5-card poker hand (hereinafter referred as "the Banker's hand") and discards two cards from the Banker's seven cards, determines whether each Player's Poker Bet wager wins, loses or ties if any, determines whether each Player's Side Bet wager or wagers win, lose, or tie if any, and settles each Player's Poker Bet wager and/or each Player's Side Bet wager or wagers against the Banker.

Version 2: After a Poker Bet wager and/or one or more Side Bet wager is placed, the Banker is dealt seven cards, and each Player is dealt six cards. Each Player discard one card from the six dealt cards and receives one replacement card, and then each Player selects and keeps his or her best 5-card poker hand (hereinafter referred as the Player's hand) and discards one card from each Player's remaining six cards. The dealer then selects and keeps the Banker's best 5-card poker hand (hereinafter referred as the Banker's hand) and discards two cards from the Banker's seven cards, determines whether each Player's Poker Bet wager wins, loses or ties if any, determines whether each Player's Side Bet wager or wagers win, lose, or tie if any, and settles each Player's Poker Bet wager and/or each Player's Side Bet wager or wagers against the Banker.

Either one of the following ways, whichever is chosen for the new 8 card draw poker game, in which every Player and the Banker receive their cards and select their best 5-card poker hand:

Version I: In a preferred embodiment, after a Poker Bet wager and/or one or more Side Bet wager is placed, every Player and the Banker each is dealt seven cards either at one time or in proportionally, either face up or face down preferably face down, and one community card, which can be face up or face down. In other embodiments, every Player and the Banker each can receive their hand in either one of the following fashions:

1. They receive their own six cards and two community cards.
2. They receive their own five cards and three community cards.
3. They receive their own four cards and four community cards.
4. They receive their own three cards and five community cards.
5. They receive their own two cards and six community cards.
6. They receive their own one card and seven community cards. And
7. They receive no card their own and eight community cards ((In this version, every Player bets on the value of the eight community cards, including but not limit to betting on the best 5-card poker hand, betting on the best 6-card poker hand, or betting on the best 7-card poker hand selected from the eight community cards).

From each Player's own seven cards and one community card, each Player selects and keeps his or her best 5-card poker hand (hereinafter referred as "the Player's hand") and discards three cards, which are treated as three discards. The dealer then selects and keeps the Banker's best 5-card poker hand (hereinafter referred as "the Banker's hand") and discards three cards from the Banker's seven cards and one community card, determines whether each Player's Poker Bet wager wins, loses or ties if any, determines whether each Player's Side Bet wager or wagers win, lose, or tie if any, and settles each Player's Poker Bet wager and/or each Player's Side Bet wager or wagers against the Banker.

Version II: After a Poker Bet wager and/or one or more Side Bet wager is placed, the Banker is dealt seven cards face down, each Player is dealt six cards face down, and one community card is dealt for both the Banker and each Player, which can be face up or face down. From each Player's own six cards, each Player discards one card and receive one replacement card, and then each Player selects and keeps his or her best 5-card poker hand and discards two cards from each Player's remaining six cards and one community card. The dealer then selects and keeps the Banker's best 5-card poker hand and discards three card from the Banker's seven cards and one community card, determines whether each Player's Poker Bet wager wins, loses or ties if any, determines whether each Player's Side Bet wager or wagers win, lose, or tie if any, and settles each Player's Poker Bet wager and/or each Player's Side Bet wager or wagers against the Banker.

Below are the rules of play of Poker Bet, Specified Hand Or Better Bet, Aces Pair Or Better Bet, Two Pair Or Better Bet, 3 Of A Kind Or Better Bet, Straight Or Better Bet, Flush Or Better Bet and Full House Or Better Bet of new 7 and 8 card draw poker games:

POKER BET: The object of Poker Bet is mainly to have a best 5-card poker hand that outranks the opponent's best 5-card poker hand. In the Poker Bet, the Player's best 5-card poker hand (the Player's hand) is compared to the Banker's best 5-card poker hand (the Banker's hand) according to either the rankings of the version of wild joker or the rankings of the version of semi-wild joker, whichever is chosen. The hands of the version of wild joker are ranked in descending order as follows: 5 of a Kind, Royal Flush, Straight Flush, 4 of a Kind, Full House, Flush, Straight, 3 of a Kind, Two Pair, One Pair and High Card. Ace is the highest individual card, following by King, Queen, Jack, Ten, 9, 8, 7, 6, 5, 4, 3 and 2. A, 2, 3, 4, 5 is the lowest Straight, behind 65432. The hands of the version of semi-wild joker are ranked in descending order as follows: 5 Aces, Royal Flush, Straight Flush, 4 of a Kind, Full House, Flush, Straight, 3 of a Kind, Two Pair, One Pair and High Card. Ace is the highest individual card, following by King, Queen, Jack, Ten, 9, 8, 7, 6, 5, 4, 3 and 2. A, 2, 3, 4, 5 is the second highest Straight, behind AKQJ10.

A Poker Bet wager can be settled according to either one of the Rules below, whichever is chosen:

Rules 1: If the Player's hand ranks lower than the Banker's hand, the Player's Poker Bet wager loses; if the Player and the Banker's hand rank the same, then two hands push and the Player's wager neither wins nor loses; if the Player's hand ranks higher than the Banker's, the Player's wager wins and either is paid Even Money (1 to 1) if the Banker's losing hand is a predetermined ranking hand or better, or is paid one half of the wager (1 to 2) if the Banker's losing hand is not a predetermined ranking hand or better.

Rules 2: If the Player's hand ranks lower than the Banker's hand, the Player's Poker Bet wager loses; if the Player and the Banker's hand rank the same, then two hands push and the Player's wager neither wins nor loses; if the Player's hand ranks higher than the Banker's, the Player's wager wins and either is paid Even Money if the Banker's losing hand is King-Queen or better (Ace-high, One Pair, Two Pair, 3 of a Kind, Straight, Flush, Full House, 4 of a Kind, Straight Flush, Royal Flush or better), or is paid one half of the wager (1 to 2) if the Banker's losing hand is King-Jack or lower (Queen-high, Jack-high, etc.).

Rules 3: If the Banker's hand is not a predetermined qualifying hand (predetermined ranking hand) or better, the Player's Poker Bet wager wins (it does not matter whether the Player's hand ranks higher, ranks the same, or ranks lower than the Banker's) and is paid one half of the wager, namely 1 to 2; if the Player's hand ranks higher than the Banker's and the Banker's hand is a predetermined qualifying hand or better, the Player's wager wins and is paid Even Money, namely 1 to 1; if the Player's hand ranks lower than the Banker's and the Banker's hand is the predetermined qualifying hand or better, the Player's wager loses; and if the Player's and the Banker's hand rank the same and the Banker's hand is the predetermined qualifying hand or better, then the two hands push and the Player's wager neither wins nor loses.

Rules 4: If the Banker's hand is not a qualifying hand of Ace-high or better, the Player's Poker Bet wager wins and is paid one half of the wager, namely 1 to 2; if the Player's hand ranks higher than the Banker's and the Banker's hand is a qualifying hand of Ace-high or better (One Pair, Two Pair, 3 of a Kind, Straight, Flush, Full House, 4 of a Kind, Straight Flush, Royal Flush or better), the Player's wager wins and is paid Even Money, namely 1 to 1; if the Player's hand ranks lower than the Banker's and the Banker's hand is a qualifying hand of Ace-high or better, the Player's wager loses; and if the Player's and the Banker's hand rank the same and the Banker's hand is a qualifying hand of Ace-high or better, then two hands push and the Player's wager neither wins nor loses.

Rules 5: If a Player's hand ranks higher than the Banker's hand, the Player's wager wins and can be paid according to either a predetermined pay table or a predetermined payoff odds; if the Player's and the Banker's hand rank the same, then two hands push and the Player's wager neither wins nor loses; and if the Player's hand ranks lower than the Banker's, then the Player's wager loses.

Rules 6: If the Player is dealt either a predetermined hand (this can be any hand; i.e. a hand of 7 Card Straight Flush) or one of the predetermined hands (these can be two or more specified hands; i.e. one of the predetermined hands of Straight Flush, Royal Flush and 5 Aces) whichever is chosen, or if the Player's hand ranks higher than the Banker's, the Player's Poker Bet wager wins and either is paid Even Money (1 to 1) if the Banker's losing hand is a predetermined ranking hand or better, or is paid one half of the wager (1 to 2) if the Banker's losing hand is not a predetermined ranking hand or better; if the Player is not dealt either a predetermined hand or one of the predetermined hands, whichever is chosen, and the Player's hand ranks lower than the Banker's, the Player's wager loses; if the Player is not dealt either a predetermined hand or one of the predetermined hands, whichever is chosen, and the Player and the Banker's hand rank the same, then the two hands push and the Player's wager neither wins nor loses.

Rules 7: If the Player is dealt either a predetermined hand or one of the predetermined hands, whichever is chosen, or if the Player's hand ranks higher than the Banker's, the Player's Poker Bet wager wins and either is paid Even Money if the Banker's losing hand is King-Queen or better, or is paid one half of the wager (1 to 2) if the Banker's losing hand is King-Jack or lower; if the Player is not dealt either a predetermined hand or one of the predetermined hands, whichever is chosen, and the Player's hand ranks lower than the Banker's hand, the Player's wager loses; and if the Player is not dealt either a predetermined hand or one of the predetermined hands, whichever is chosen, and the Player and the Banker's hand rank the same, then the two hands push and the Player's wager neither wins nor loses;

Rules 8: If the Banker's hand is not a predetermined qualifying hand or better, the Player's Poker Bet wager wins and is paid one half of the wager, namely 1 to 2; If the Player is dealt either a predetermined hand or one of the predetermined hands, whichever is chosen, and the Banker's hand is not a predetermined qualifying hand or better, or if the Player's hand ranks higher than the Banker's hand and the Banker's hand is a predetermined qualifying hand or better, the Player's wager wins and is paid Even Money, namely 1 to 1; if the Player is not dealt either a predetermined hand or one of the predetermined hands, whichever is chosen, and the Player's hand ranks lower than the Banker's and the Banker's hand is the predetermined qualifying hand or better, the Player's wager loses; and if the Player is not dealt either a predetermined hand or one of the predetermined hands, whichever is chosen, and the Player's and the Banker's hand rank the same and the Banker's hand is the predetermined qualifying hand or better, then the two hands push and the Player's wager neither wins nor loses.

Rules 9: If the Banker's hand is not a qualifying hand of Ace-high or better, the Player's Poker Bet wager wins and is paid one half of the wager, namely 1 to 2; if the Player is dealt either a predetermined hand or one of the predetermined hands, whichever is chosen, or if the Player's hand ranks higher than the Banker's hand and the Banker's hand is a qualifying hand of Ace-high or better, the Player's wager wins and is paid Even Money, namely 1 to 1; if the Player is not dealt either a predetermined hand or one of the predetermined hands, whichever is chosen, and the Player's hand ranks lower than the Banker's and the Banker's hand is a qualifying hand of Ace-high or better, the Player's wager loses; and if the Player is not dealt either a predetermined hand or one of the predetermined hands, whichever is chosen, and the Player's and the Banker's hand rank the same and the Banker's hand is a qualifying hand of Ace-high or better, then the two hands push and the Player's wager neither wins nor loses.

Rules 10: If the Player is dealt either a predetermined hand or one of the predetermined hands, whichever is chosen, or if a Player's hand ranks higher than the Banker's hand, the Player's Poker Bet wager wins and can be paid according to either a predetermined pay table or a predetermined payoff odds, whichever is chosen; if the Player is not dealt either a predetermined hand or one of the predetermined hands, whichever is chosen, and the Player's and the Banker's hand rank the same, then the two hands push and the Player's wager neither wins nor loses; and if the Player is not dealt either a predetermined hand or one of the predetermined hands, whichever is chosen, and the Player's hand ranks lower than the Banker's hand, then the Player loses his or her wager.

SIBE BET: The game or games of Side Bet can be designed to include any one or any combination of the following types of games: Specified Hand Or Better Bet, Pair Of Kings Or Better Bet, Pair Of Aces Or Better Bet, Two Pair Or Better Bet, 3 Of A Kind Or Better Bet, Straight Or Better Bet, Flush Or Better Bet and Full House Or Better Bet.

Either one of four Rules below can be chosen for the game of Specified Hand Or Better Bet.

Rules 1: If the Player's hand ranks higher the Banker's hand with a predetermined hand or better, the Player's Specified Hand Or Better Bet wager wins and can be paid according to either a predetermined pay table or a predetermined payoff odds, whichever is chosen; if the Player's hand ranks higher than the Banker's with a hand that is not the predetermined hand or better, or if the Player's hand ranks lower than or ranks the same as the Banker's, the Player's wager loses.

Rules 2: If the Player's hand ranks higher than or ranks the same as the Banker's hand with a predetermined hand or better, the Player's Specified Hand Or Better Bet wager win and can be paid according to either a predetermined pay table or a predetermined payoff odds, whichever is chosen; if the Player's hand ranks higher than the Banker's with a hand that is not the predetermined hand or better, or if the Player's hand ranks lower than the Banker's, the Player's wager loses.

Rules 3: If the Player is dealt either first predetermined hand or one of predetermined hands, whichever rules is chosen, or if the Player's hand ranks higher than the Banker's hand with second predetermined hand or better, the Player's Specified Hand Or Better Bet wager wins and can be paid according to either a predetermined pay table or a predetermined payoff odds, whichever is chosen; if the Player is not dealt either first predetermined hand or one of the predetermined hands, whichever is chosen, and the Player's hand ranks higher than the Banker's with a hand that is not the second predetermined hand or better, or if the Player is not dealt either first predetermined hand or one of the predetermined hands, whichever is chosen, and the Player's hand ranks lower than or ranks the same as the Banker's, the Player's wager loses.

Rules 4: If the Player is dealt either first predetermined hand or one of predetermined hands, whichever rules is chosen, or if the Player's hand ranks higher than or ranks the same as the Banker's hand with second predetermined hand or better, the Player's Specified Hand Or Better Bet wager wins and can be paid according to either a predetermined pay table or a predetermined payoff odds, whichever is chosen; if the Player is not dealt either first predetermined hand or one of predetermined hands, whichever rules is chosen, and the Player's hand ranks higher than the Banker's with a hand that is not the second predetermined hand or better, or if the Player is not dealt either first predetermined hand or one of predetermined hands, whichever rules is chosen, the Player's hand ranks lower than the Banker's, the Player's wager loses.

PAIR OF KINGS OR BETTER BET: Either one of four Rules below can be chosen for the game of Pair Of Kings Or Better Bet.

Rules 1: If the Player's hand ranks higher than the Banker's hand with a pair of Kings or better (a pair of Aces, Two Pair, 3 of a Kind, Straight, Flush, Full House, 4 of a Kind, Straight Flush, Royal Flush and either 5 Aces if the version of semi-wild joker is chosen or 5 of a Kind if the version of wild joker is chosen), the Player's Pair Of Kings Or Better Bet wager wins and can be paid according to either a predetermined pay table or a predetermined payoff odds, whichever is chosen; if the Player's hand ranks lower than or ranks the same as the Banker's hand with a pair of Kings or better or if the Player's hand ranks is a pair of Queens or lower, the Player's wager loses.

Rules 2: If the Player's hand ranks higher than or ranks the same as the Banker's hand with a pair of Kings or better, the Player's Pair Of Kings Or Better Bet wager wins can be paid according to either a predetermined pay table or a predetermined payoff odds, whichever is chosen; if the Player's hand ranks lower than the Banker's with a pair of Kings or better or if the Player's hand is a pair of Queens or lower, the Player's wager loses.

Rules 3: If the Player is dealt either a predetermined hand or one of predetermined hands, whichever is chosen, or if the Player's hand ranks higher than the Banker's with a pair of Kings or better, the Player's Pair Of Kings Or Better Bet wager wins paid according to either a predetermined pay table or a predetermined payoff odds; if the Player is not dealt either the predetermined hand or one of predetermined hands, whichever is chosen, and the Player's hand ranks lower than or ranks the same as the Banker's with a Pair Of Kings Or Better or if the Player is not dealt either the predetermined hand or one of predetermined hands, whichever is chosen, and the Player's hand is a pair of Queens or lower, the Player's wager loses.

Rules 4: If the Player is dealt either a predetermined hand or one of predetermined hands, whichever rules is chosen, or if the Player's hand ranks higher than or ranks the same as the Banker's hand with a pair of Kings or better, the Player's Pair Of Kings Or Better Bet wager wins and can be paid according to either a predetermined pay table a predetermined payoff odds, whichever is chosen; if the Player is not dealt either the predetermined hand or one of predetermined hands, whichever is chosen, and the Player's hand ranks lower than the Banker's with a Pair Of Kings Or Better or if the Player is not dealt either the predetermined hand or one of predetermined hands, whichever is chosen, and the Player's hand is a pair of Queens or lower, the Player's wager loses.

PAIR OF ACES OR BETTER BET: Either one of four Rules below can be chosen for the game of Pair Of Aces Or Better Bet.

Rules 1: If the Player's hand ranks higher than the Banker's hand with a pair of Aces or better (Two Pair, 3 of a Kind, Straight, Flush, Full House, 4 of a Kind, Straight Flush, Royal Flush and either 5 Aces if the version of semi-wild joker is chosen or 5 of a Kind if the version of wild joker is chosen), the Player's Pair Of Aces Or Better Bet wager wins and can be paid according to either a predetermined pay table or a predetermined payoff odds, whichever is chosen; if the Player's hand ranks lower than or ranks the same as the Banker's a pair of Aces or better, or if the Player's hand is a pair of Kings or lower, the Player's wager loses.

Rules 2: If the Player's hand ranks higher than or ranks the same as the Banker's hand with a pair of Aces or better, the Player's Pair Of Aces Or Better Bet wager wins and can be paid according to either a predetermined pay table or a predetermined payoff odds, whichever is chosen; if the Player's hand ranks lower than the Banker's a pair of Aces or better, or if the Player's hand is a pair of Kings or lower, the Player's wager loses.

Rules 3: If the Player is dealt either a predetermined hand or one of predetermined hands, whichever rules is chosen, or the Player's hand ranks higher than or ranks the same as the Banker's hand with a pair of Aces or better, the Player's Pair Of Aces Or Better Bet wager wins and can be paid according to either a predetermined pay table or a predetermined payoff odds, whichever is chosen; if the Player is not dealt either a predetermined hand or one of predetermined hands, whichever is chosen, and the Player's hand ranks lower than the Banker's a pair of Aces or better, or if the Player is not dealt either a predetermined hand or one of predetermined hands, whichever is chosen, and the Player's hand is a pair of Kings or lower, the Player's wager loses.

Rules 4: If the Player is dealt either a predetermined hand or one of predetermined hands, whichever rules is chosen, or the Player's hand ranks higher than the Banker's hand with a pair of Aces or better, the Player's Pair Of Aces Or Better Bet wager wins and can be paid according to either a predetermined pay table or a predetermined payoff odds, whichever is chosen; if the Player is not dealt either a predetermined hand or one of predetermined hands, whichever is chosen, and the Player's hand ranks the same or ranks lower than the Banker's a pair of Aces or better, or if the Player is not dealt either a predetermined hand or one of predetermined hands, whichever is chosen, and the Player's hand is a pair of Kings or lower, the Player's wager loses.

TWO PAIR OR BETTER BET: Either one of four Rules below can be chosen for the game of Two Pair Or Better Bet.

Rules 1: If the Player's hand ranks higher than or ranks the same as the Banker's hand with Two Pair or better (3 of a Kind, Straight, Flush, Full House, 4 of a Kind, Straight Flush, Royal Flush and either 5 Aces if the version of semi-wild joker is chosen or 5 of a Kind if the version of wild joker is chosen), the Player's Two Pair Or Better Bet wager wins and can be paid according to either a predetermined pay table or a predetermined payoff odds, whichever is chosen; if the Player's hand ranks lower than the Banker's with Two Pair or better, or if the Player's hand is a pair of Aces or lower, the Player's wager loses.

Rules 2: If the Player's hand ranks higher than the Banker's hand with Two Pair or better, the Player's Two Pair Or Better Bet wager wins and can be paid according to either a predetermined pay table or a predetermined payoff odds, whichever is chosen; if the Player's hand ranks the same as or ranks lower than the Banker's with Two Pair or better, or if the Player's hand is a pair of Aces or lower, the Player's wager loses.

Rules 3 If the Player is dealt either a predetermined hand or one of predetermined hands, whichever rules is chosen, or if the Player's hand ranks higher than or ranks the same as the Banker's hand with Two Pair or better, the Player's Two Pair Or Better Bet wager wins and can be paid according to either a predetermined pay table or a predetermined payoff odds, whichever is chosen; if the Player is not dealt either a predetermined hand or one of predetermined hands, whichever rules is chosen, and the Player's hand ranks lower than the Banker's with Two Pair or better, or if the Player is not dealt either a predetermined hand or one of predetermined hands, whichever rules is chosen, and the Player's hand is a pair of Aces or lower, the Player's wager loses.

Rules 4: If the Player is dealt either a predetermined hand or one of predetermined hands, whichever rules is chosen, or if the Player's hand ranks higher than the Banker's hand with Two Pair or better, the Player's Two Pair Or Better Bet wager wins and can be paid according to either a predetermined pay table or a predetermined payoff odds, whichever is chosen; if the Player is not dealt either a predetermined hand or one of predetermined hands, whichever rules is chosen, and the Player's hand ranks the same as or ranks lower than the Banker's with Two Pair or better, or if the Player is not dealt either a predetermined hand or one of predetermined hands, whichever rules is chosen, and the Player's hand is a pair of Aces or lower, the Player's wager loses.

3 OF A KIND OR BETTER BET: Either one of four Rules below can be chosen for the game of 3 Of A Kind Or Better Bet.

Rules 1: If the Player's hand ranks higher than or ranks the same as the Banker's hand with 3 of a Kind or better (Straight, Flush, Full House, 4 of a Kind, Straight Flush, Royal Flush and either 5 Aces if the version of semi-wild joker is chosen or 5 of a Kind if the version of wild joker is chosen), the Player's 3 Of A Kind Or Better Bet wager wins and can be paid according to either a predetermined pay table or a predetermined payoff odds, whichever is chosen; if the Player's hand ranks lower than the Banker's with 3 of a Kind or better, or if the Player's hand is a pair of Two Pair or lower, the Player's wager loses.

Rules 2: If the Player's hand ranks higher than the Banker's hand with 3 of a Kind or better, the Player's 3 Of A Kind Or Better Bet wager wins and can be paid according to either a predetermined pay table or a predetermined payoff odds, whichever is chosen; if the Player's hand ranks the same as or ranks lower than the Banker's with 3 of a Kind or better, or if the Player's hand is a pair of Two Pair or lower, the Player's wager loses.

Rules 3 If the Player is dealt either a predetermined hand or one of predetermined hands, whichever rules is chosen, or if the Player's hand ranks higher than or ranks the same as the Banker's hand with 3 of a Kind or better, the Player's 3 Of A Kind Or Better Bet wager wins and can be paid according to either a predetermined pay table or a predetermined payoff odds, whichever is chosen; if the Player is not dealt either a predetermined hand or one of predetermined hands, whichever rules is chosen, and the Player's hand ranks lower than the Banker's with 3 of a Kind or better, or if the Player is not dealt either a predetermined hand or one of predetermined hands, whichever rules is chosen, and the Player's hand is Two Pair or lower, the Player's wager loses.

Rules 4: If the Player is dealt either a predetermined hand or one of predetermined hands, whichever rules is chosen, or if the Player's hand ranks higher than the Banker's hand with 3 of a Kind or better, the Player's 3 Of A Kind Or Better Bet wager wins and can be paid according to either a predetermined pay table or a predetermined payoff odds, whichever is chosen; if the Player is not dealt either a predetermined hand or one of predetermined hands, whichever rules is chosen, and the Player's hand ranks the same as or ranks lower than the Banker's with 3 of a Kind or better, or if the Player is not dealt either a predetermined hand or one of predetermined hands, whichever rules is chosen, and the Player's hand is Two Pair or lower, the Player's wager loses.

STRAIGNT OR BETTER BET: Either one of four Rules below can be chosen for the game of Straight Or Better Bet.

Rules 1: If the Player's hand ranks higher than or ranks the same as the Banker's hand with Straight or better (Flush, Full House, 4 of a Kind, Straight Flush, Royal Flush and either 5 Aces if the version of semi-wild joker is chosen or 5 of a Kind if the version of wild joker is chosen), the Player's Straight Or Better Bet wager wins and can be paid according to either a predetermined pay table or a predetermined payoff odds, whichever is chosen; if the Player's hand ranks lower than the Banker's with Straight or better, or if the Player's hand is 3 of a Kind or lower, the Player's wager loses.

Rules 2: If the Player's hand ranks higher than the Banker's hand with Straight or better, the Player's Straight Or Better Bet wager wins and can be paid according to either a predetermined pay table or a predetermined payoff odds, whichever is chosen; if the Player's hand ranks the same as or ranks lower than the Banker's with Straight or better, or if the Player's hand is 3 of a Kind or lower, the Player's wager loses.

Rules 3 If the Player is dealt either a predetermined hand or one of predetermined hands, whichever rules is chosen, or if the Player's hand ranks higher than or ranks the same as the Banker's hand with Straight or better, the Player's Straight Or Better Bet wager wins and can be paid according to either a predetermined pay table or a predetermined payoff odds, whichever is chosen; if the Player is not dealt either a predetermined hand or one of predetermined hands, whichever rules is chosen, and the Player's hand ranks lower than the Banker's with Straight or better, or if the Player is not dealt either a predetermined hand or one of predetermined hands, whichever rules is chosen, and the Player's hand is 3 of a Kind or lower, the Player's wager loses.

Rules 4: If the Player is dealt either a predetermined hand or one of predetermined hands, whichever rules is chosen, or if the Player's hand ranks higher than the Banker's hand with Straight or better, the Player's Straight Or Better Bet wager wins and can be paid according to either a predetermined pay table or a predetermined payoff odds, whichever is chosen; if the Player is not dealt either a predetermined hand or one of predetermined hands, whichever rules is chosen, and the Player's hand ranks the same as or ranks lower than the Banker's with Straight or better, or if the Player is not dealt either a predetermined hand or one of predetermined hands, whichever rules is chosen, and the Player's hand is 3 of a Kind or lower, the Player's wager loses.

FLUSH OR BETTER BET: Either one of four Rules below can be chosen for the game of Flush Or Better Bet.

Rules 1: If the Player's hand ranks higher than or ranks the same as the Banker's hand with Flush or better (Full House, 4 of a Kind, Straight Flush, Royal Flush and either 5 Aces if the version of semi-wild joker is chosen or 5 of a Kind if the version of wild joker is chosen), the Player's Flush Or Better Bet wager wins and can be paid according to either a predetermined pay table or a predetermined payoff odds, whichever is chosen; if the Player's hand ranks lower than the Banker's with Flush or better, or if the Player's hand is Straight or lower, the Player's wager loses.

Rules 2: If the Player's hand ranks higher than the Banker's hand with Flush or better, the Player's Flush Or Better Bet wager wins and can be paid according to either a predetermined pay table or a predetermined payoff odds, whichever is chosen; if the Player's hand ranks the same as or ranks lower than the Banker's with Flush or better, or if the Player's hand is Straight or lower, the Player's wager loses.

Rules 3 If the Player is dealt either a predetermined hand or one of predetermined hands, whichever rules is chosen, or if the Player's hand ranks higher than or ranks the same as the Banker's hand with Flush or better, the Player's Flush Or Better Bet wager wins and can be paid according to either a predetermined pay table or a predetermined payoff odds, whichever is chosen; if the Player is not dealt either a predetermined hand or one of predetermined hands, whichever rules is chosen, and the Player's hand ranks lower than the Banker's with Flush or better, or if the Player is not dealt either a predetermined hand or one of predetermined hands, whichever rules is chosen, and the Player's hand is Straight or lower, the Player's wager loses.

Rules 4: If the Player is dealt either a predetermined hand or one of predetermined hands, whichever rules is chosen, or if the Player's hand ranks higher than the Banker's hand with Flush or better, the Player's Flush Or Better Bet wager wins and can be paid according to either a predetermined pay table or a predetermined payoff odds, whichever is chosen; if the Player is not dealt either a predetermined hand or one of predetermined hands, whichever rules is chosen, and the Player's hand ranks the same as or ranks lower than the Banker's with Flush or better, or if the Player is not dealt either a predetermined hand or one of predetermined hands, whichever rules is chosen, and the Player's hand is Straight or lower, the Player's wager loses.

FULL HOUSE OR BETTER BET: Either one of four Rules below can be chosen for the game of Full House Or Better Bet.

Rules 1: If the Player's hand ranks higher than or ranks the same as the Banker's hand with Full House or better (4 of a Kind, Straight Flush, Royal Flush and either 5 Aces if the version of semi-wild joker is chosen or 5 of a Kind if the version of wild joker is chosen), the Player's Full House Or Better Bet wager wins and can be paid according to either a predetermined pay table or a predetermined payoff odds, whichever is chosen; if the Player's hand ranks lower than the Banker's with Full House or better, or if the Player's hand is Flush or lower, the Player's wager loses.

Rules 2: If the Player's hand ranks higher than the Banker's hand with Full House or better, the Player's Full House Or Better Bet wager wins and can be paid according to either a predetermined pay table or a predetermined payoff odds, whichever is chosen; if the Player's hand ranks the same as or ranks lower than the Banker's with Full House or better, or if the Player's hand is Flush or lower, the Player's wager loses.

Rules 3 If the Player is dealt either a predetermined hand or one of predetermined hands, whichever rules is chosen, or if the Player's hand ranks higher than or ranks the same as the Banker's hand with Full House or better, the Player's Full House Or Better Bet wager wins and can be paid according to either a predetermined pay table or a predetermined payoff odds, whichever is chosen; if the Player is not dealt either a predetermined hand or one of predetermined hands, whichever rules is chosen, and the Player's hand ranks lower than the Banker's with Full House or better, or if the Player is not dealt either a predetermined hand or one of predetermined hands, whichever rules is chosen, and the Player's hand is Flush or lower, the Player's wager loses.

Rules 4: If the Player is dealt either a predetermined hand or one of predetermined hands, whichever rules is chosen, or if the Player's hand ranks higher than the Banker's hand with Full House or better, the Player's Full House Or Better Bet wager wins and can be paid according to either a predetermined pay table or a predetermined payoff odds, whichever is chosen; if the Player is not dealt either a predetermined hand or one of predetermined hands, whichever rules is chosen, and the Player's hand ranks the same as or ranks lower than the Banker's with Full House or better, or if the Player is not dealt either a predetermined hand or one of predetermined hands, whichever rules is chosen, and the Player's hand is Flush or lower, the Player's wager loses.

Alternatively, either new draw poker game can be designed to include either only the Poker Bet game, only any one of the Side Bet games, or only any combination of the Side Bet games.

Alternatively, with some modifications of the rules of play, either new draw poker game can be designed to allow Players to bet on the Side Bet game(s) based on the Banker's hand.

What is claimed is:

1. A method of playing a card game among a plurality of Players and a Banker, each Player wagering against the Banker, comprising the steps of:

(a) providing and shuffling at least one standard poker deck of 52 cards plus at least one Joker, wherein the Joker may be used as an Ace or to complete a Straight or Flush;

(b) placing either a Poker Bet wager or Pair Of Aces Or Better Bet wager, or both;

(c) placing an optional Bonus Bet wager;

(d) dealing cards, seven cards dealt either at one time or proportionally, into enough dealt hands of seven cards to provide a dealt hand for each Player and for the Banker;

(e) determining which dealt hand is assigned to each Player and which dealt hand is assigned to the Banker;

(f) from their own seven-card dealt hand, each Player and the Banker selecting and keeping their own best 5-card poker hand and discarding two other cards;

(g) determining whether each Player's Pair Of Aces Or Better Bet wager wins or loses, if any;

(h) settling each Player's Pair Of Aces Or Better wager against the Banker;

(i) determining whether each Player's Poker Bet wager wins, loses or ties, if any; wherein each Player's best 5-card poker hand is compared to the Banker's best 5-card poker hand according to the rankings wherein hands are ranked in descending order as follows: 5 Aces, Royal Flush, Straight Flush, 4 of a Kind, Full House, Flush, Straight, 3 of a Kind, Two Pair, One Pair and High Card; wherein Ace is the highest High Card, following by King, Queen, Jack, Ten, 9, 8, 7, 6, 5, 4, 3 and 2; wherein A2345 is the second highest Straight and that it is suited, A2345 is the second highest Straight Flush;

(j) settling each Player's Poker Bet wager against the Banker;

(k) determining whether each Player's Bonus Bet wager wins, loses, or ties, if any; and (l) settling each Player's Bonus Bet wager against the Banker.

2. The method of playing a card game according to claim 1, wherein a Player's Pair Of Aces Or Better Bet wager wins if the Player is dealt a 7 Card 9 High hand or a 7 Card Straight Flush hand, or if the Player's hand is a pair of Aces, Two Pair, 3 of a Kind, Straight, Flush, Full House, 4 of a Kind, Straight Flush, Royal Flush or 5 Aces; and the Player's wager loses if the Player is not dealt a 7 Card 9 High hand or a 7 Card Straight Flush, and the Player's hand is a pair of Kings or lower; and the player's winning wager may be paid according to either a predetermined pay table or a predetermined payoff odds.

3. The method of playing a card game according to claim 2, wherein the Player's winning Pair Of Aces Or Better wager is paid as follows:

| Hand | Payoff Odds |
|---|---|
| Two Pair Or Better | 1 to 1 |
| Two Or More Aces | 3 to 2 |
| 7 Card 9 High | 1 to 1 |

4. The method of playing a card game according to claim 2, wherein the Player's winning Pair Of Aces Or Better wager is paid as follows:

| Hand | Payout Odds |
|---|---|
| 7 Card Straight Flush with No Joker | 200 to 1 |
| 7 Card Straight Flush with Joker | 100 to 1 |
| 5 Aces | 50 to 1 |
| Royal Flush with No Joker | 30 to 1 |
| Royal Flush with Joker | 20 to 1 |
| Straight Flush | 7 to 1 |
| 4 of a Kind | 6 to 1 |
| Full House | 2 to 1 |
| Pair of Aces through Flush | 1 to 1 |
| 7 Card 9 High | 1 to 1 |

5. The method of playing a card game according to claim 1, wherein if the Player is dealt a 7 Card 9 High hand or a 7 Card Straight Flush hand, or if the Player's best 5-card poker hand ranks the same as or ranks higher than the Banker's best 5-card poker hand, the Player's Poker Bet wager wins and either is paid Even Money, namely 1 to 1, if the Banker's losing hand is a hand of King-Queen or better or is paid one half of the wager, namely 1 to 2, if the Banker's hand is a hand of King-Jack or lower; if the Player is not dealt a 7 Card 9 High hand or a 7 Card Straight Flush hand, and the Player's best 5-card poker hand ranks lower than the Banker's, the Player's Poker Bet wager loses.

6. The method of playing a card game according to claim 1, wherein if the Player is dealt a 7 Card 9 High hand or a 7 Card Straight Flush hand, or if the Player's best 5-card poker hand ranks the same as or ranks higher than the Banker's best 5-card poker hand, the Player's Poker Bet wager wins and either is paid Even Money, namely 1 to 1, if the Banker's losing hand is a predetermined rank or better or is paid one half of the wager, namely 1 to 2, if the Banker's hand is not a predetermined rank or better; if the Player is not dealt a 7 Card 9 High hand or a 7 Card Straight Flush hand, and the Player's best 5-card poker hand ranks lower than the Banker's, the Player's Poker Bet wager loses.

7. The method of playing a card game according to claim 1, wherein if the Player is dealt a 7 Card 9 High hand or a 7 Card Straight Flush hand, or if the Player's best 5-card poker hand ranks the same as or ranks higher than the Banker's, the Player's Poker Bet wager wins and is paid Even Money, namely 1 to 1, less a predetermined percent commission; if the Player is not dealt a 7 Card 9 High hand or a 7 Card Straight Flush hand, and the Player's best 5-card poker hand ranks lower than the Banker's, the Player's Poker Bet wager loses.

8. The method of playing a card game according to claim 7, wherein the predetermined percent commission is a five percent commission.

9. The method of playing a card game according to claim 1, wherein if the Banker's best 5-card poker hand is not a predetermined rank or better, the Player's Poker Bet wager wins and is paid one half of the wager, namely 1 to 2, even the Player's best 5-card poker hand ranks lower than the Banker's; if the Player is not dealt a 7 Card 9 High hand or a 7 Card Straight Flush hand, and the Player's best 5-card poker hand ranks lower than the Banker's and the Banker's best 5-card poker hand is the predetermined rank or better, the Player's wager loses; if the Player is dealt a 7 Card 9 High hand or a 7 Card Straight Flush hand, and the Player's best 5-card poker hand ranks higher than or ranks the same as the Banker's and the Banker's best 5-card poker hand is the predetermined hand or better, the Player's wager wins and is paid Even Money, namely 1 to 1.

10. The method of playing a card game according, to claim 1, wherein if the Banker's best 5-card poker hand is not a predetermined rank or better, the Player's Poker Bet wager wins and is paid one half of the wager, namely 1 to 2; if the Player's best 5-card poker hand ranks lower than the Banker's and the Banker's best 5-card poker hand is the predetermined rank or better, the Player's Poker Bet wager loses; if the Player's best 5-card poker hand ranks higher than or ranks the same as the Banker's and the Banker's best 5-card poker hand is the predetermined hand or better, the Player's wager wins and may be paid according to either a predetermined payoff odds or a predetermined pay table.

11. The method of playing a card game according to claim 1, wherein a Player's Bonus Bet wager wins if the Player is dealt a 7 Card 9 High hand or a 7 Card Straight Flush hand, or if the Player's best 5-card poker hand ranks the same as or ranks higher than the Banker's with a predetermined rank or better; the Player's Bonus Bet wager is a push and neither wins nor loses if the Player is not dealt a 7 Card 9 High hand or a 7 Card Straight Flush hand, and the Player's best 5-card poker hand ranks lower than the Banker's with the predetermined rank or better; the Player's Bonus Bet wager loses if the Player is not dealt a 7 Card 9 High hand or a 7 Card Straight Flush hand, and the Player's best 5-card poker hand is not the predetermined rank or better; and the Player's winning Bonus Bet wager may be paid according to either a predetermined payoff odds or a predetermined pay table.

12. The method of playing a card game according to claim 1, wherein a Player's Bonus Bet wager wins if the Player is dealt a 7 Card 9 High hand or a 7 Card Straight Flush hand, or if the Player's best 5-card poker hand ranks the same as or ranks higher than the Banker's best 5-card poker hand with 3 of a Kind, Straight, Flush, Full House, 4 of a Kind, Straight Flush, Royal Flush or 5 Aces; the Player's Bonus Bet wager is a push and neither wins nor loses if the Player is not dealt a 7 Card 9 High hand or a 7 Card Straight Flush hand, and the Player's best 5-card poker hand ranks lower than the Banker's with 3 of a Kind or better; the Player's Bonus Bet wager loses if the Player is not dealt a 7 Card 9 High hand or a 7 Card Straight Flush hand, and the Player's best 5-card poker hand is Two Pair or lower; and the Player's winning Bonus Bet wager is paid as follows:

| Hand | Payout Odds |
|---|---|
| 7 Card Straight Flush With No Joker | 10,000 to 1 |
| 7 Card Straight Flush With Joker | 3,000 to 1 |
| 5 Aces | 1,000 to 1 |
| Royal Flush | 400 to 1 |
| Wild Royal Flush | 200 to 1 |
| Straight Flush | 75 to 1 |
| 4 of a Kind | 40 to 1 |
| Full House | 6 to 1 |
| Flush | 3 to 1 |
| Straight | 2 to 1 |
| 3 Of A Kind | 2 to 1 |
| 7 Card 9 High | 10 to 1 |

13. The method of playing a card game according to claim 1, wherein a Player's Bonus Bet wager wins if the Player is dealt a 7 Card 9 High hand or a 7 Card Straight Flush hand, or if the Player's best 5-card poker hand ranks the same as or ranks higher than the Banker's hand with 3 of a Kind, Straight, Flush, Full House, 4 of a Kind, Straight Flush, Royal Flush or 5 Aces; the Player's Bonus Bet wager is a push and neither wins nor loses if the Player is not dealt a 7 Card 9 High hand or a 7 Card Straight Flush hand, and the Player's best 5-card poker hand ranks lower than the Banker's with 3 of a Kind or better; the Player's Bonus Bet wager loses if the Player is not dealt a 7 Card 9 High hand or a 7 Card Straight Flush hand, and the Player's best 5-card poker hand is Two Pair or lower; and the Player's winning Bonus Bet wager may be paid according to either a predetermined pay table or a predetermined payoff odds.

14. The method of playing a card game according to claim 1, wherein a Player's Bonus Bet wager wins if the Player is dealt a 7 Card 9 High hand or a 7 Card Straight Flush hand, or if the Player's best 5-card poker hand ranks the same as or ranks higher than the Banker's hand with Straight, Flush, Full House, 4 of a Kind, Straight Flush, Royal Flush or 5 Aces; the Player's Bonus Bet wager is a push and neither wins nor loses if the Player is not dealt a 7 Card 9 High hand or a 7 Card Straight Flush hand, and the Player's best 5-card poker hand ranks lower than the Banker's with Straight or better; the Player's wager loses if the Player is not dealt a 7 Card 9 High hand or a 7 Card Straight Flush hand, and the Player's hand is 3 of a Kind or lower; and the Player's winning Bonus Bet wager is paid as follows:

| Hand | Payout Odds |
|---|---|
| 7 Card Straight Flush With No Joker | 10,000 to 1 |
| 7 Card Straight Flush With Joker | 5,000 to 1 |
| 5 Aces | 2,000 to 1 |
| Royal Flush | 500 to 1 |
| Wild Royal Flush | 200 to 1 |
| Straight Flush | 100 to 1 |
| 4 of a Kind | 50 to 1 |
| Full House | 6 to 1 |
| Flush | 4 to 1 |
| Straight | 2 to 1 |
| 7 Card 9 High | 10 to 1 |

15. The method of playing a card game according to claim 1, wherein a Player's Bonus Bet wager wins if the Player is dealt a 7 Card 9 High hand or a 7 Card Straight Flush hand, or if the Player's best 5-card poker hand ranks the same as or ranks higher than the Banker's hand with Straight, Flush, Full House, 4 of a Kind, Straight Flush, Royal Flush or 5 Aces; the Player's Bonus Bet wager is a push and neither wins nor loses if the Player is not dealt a 7 Card 9 High hand or a 7 Card Straight Flush hand, and the Player's best 5-card poker hand ranks lower than the Banker's with Straight or better; and the Player's Bonus Bet wager loses if the Player is not dealt a 7 Card 9 High hand or a 7 Card Straight Flush hand, and the Player's best 5-card poker hand is 3 of a Kind or lower; and the Player's winning Bonus Bet wager may be paid according to either a predetermined pay table or a predetermined payout odds.

16. The method of playing a card game according to claim 1, wherein a Player's Bonus Bet wager wins if the Player is dealt a 7 Card 9 High hand or a 7 Card Straight Flush hand, or if the Player's best 5-card poker hand ranks the same as or ranks higher than the Banker's best 5-card poker hand with Flush, Full House, 4 of a Kind, Straight Flush, Royal Flush or 5 Aces; the Player's Bonus Bet wager is a push and neither wins nor loses if the Player is not dealt a 7 Card 9 High hand or a 7 Card Straight Flush hand, and the Player's best 5-card poker hand ranks lower than the Banker's with Flush or better; the Player's Bonus Bet wager loses if the Player is not dealt a 7 Card 9 High hand or a 7 Card Straight Flush hand, and the Player's best 5-card poker hand is Straight or lower; and the Player's winning Bonus Bet wager is paid as follows:

| Hand | Payout Odds |
|---|---|
| 7 Card Straight Flush With No Joker | 20,000 to 1 |
| 7 Card Straight Flush With Joker | 10,000 to 1 |
| 5 Aces | 3,000 to 1 |

-continued

| Hand | Payout Odds |
|---|---|
| Royal Flush With No Joker | 800 to 1 |
| Wild Royal Flush With Joker | 500 to 1 |
| Straight Flush | 150 to 1 |
| 4 of a Kind | 75 to 1 |
| Full House | 6 to 1 |
| Flush | 3 to 1 |
| 7 Card 9 High | 10 to 1 |

17. The method of playing a card game according to claim 1, wherein a Player's Bonus Bet wager wins if the Player is dealt a 7 Card 9 High hand or a 7 Card Straight Flush hand, or if the Player's best 5-card poker hand ranks the same as or ranks higher than the Banker's hand with Flush, Full House, 4 of a Kind, Straight Flush, Royal Flush or 5 Aces; the Player's Bonus Bet wager is a push and neither wins nor loses if the Player is not dealt a 7 Card 9 High hand or a 7 Card Straight Flush hand, and the Player's best 5-card poker hand ranks lower than the Banker's with Flush or better; the Player's Bonus Bet wager loses if the Player is not dealt a 7 Card 9 High hand or a 7 Card Straight Flush hand, and the Player's best 5-card poker hand is Straight or lower; and the Player's winning Bonus Bet wager may be paid according to either a predetermined pay table or a predetermined payoff odds.

18. A method of playing a card game among a plurality of Players and a Banker, each Player wagering against the Banker, comprising the steps of:

(a) providing and shuffling at least one standard poker deck of 52 cards plus at least one Joker, wherein the Joker may be used as an Ace or to complete a Straight or Flush;

(b) placing a Poker Bet wager;

(c) dealing cards, seven cards dealt either at one time or proportionally, into enough dealt hands of seven cards to provide a dealt hand for each Player and for the Banker;

(d) determining which dealt hand is assigned to each Player and which dealt hand is assigned to the Banker;

(e) from their own seven-card dealt hand, each Player and the Banker selecting and keeping their own best 5-card poker hand and discarding two other cards;

(f) determining whether each Player's Poker Bet wager wins, loses or ties; wherein each Player's best 5-card poker hand is compared to the Banker's best 5-card poker hand according to the rankings wherein hands are ranked in descending order as follows: 5 Aces, Royal Flush, Straight Flush, 4 of a Kind, Full House, Flush, Straight, 3 of a Kind, Two Pair, One Pair and High Card; wherein Ace is the highest High Card, following by King, Queen, Jack, Ten, 9, 8, 7, 6, 5, 4, 3 and 2; wherein A2345 is the second highest Straight and that it is suited, A2345 is the second highest Straight Flush; wherein if the Player is not dealt a 7 Card 9 High hand or a 7 Card Straight Flush hand, or if the Player's best 5-card poker hand ranks the same as or ranks higher than the Banker's best 5-card poker hand, the Player's Poker Bet wager wins and either is paid Even Money, namely 1 to 1, if the Banker's losing hand is a hand of King-Queen or better or is paid one half of the wager, namely 1 to 2, if the Banker's hand is a hand of King-Jack or lower; if the Player is not dealt a 7 Card 9 High hand or a 7 Card Straight Flush hand, and the Player's best 5-card poker hand ranks lower than the Banker's, the Player's Poker Bet wager loses; and (g) settling each Player's wager against the Banker.

19. A method of playing a card game among a plurality of Players and a Banker, each Player wagering against the Banker, comprising the steps of:

(a) providing and shuffling at least one standard poker deck of 52 cards plus at least one Joker, wherein the Joker may be used as an Ace or to complete a Straight or Flush;

(b) placing a Pair Of Aces Or Better Bet wager;

(c) dealing cards, seven cards dealt either at one time or proportionally, into enough dealt hands of seven cards to provide a dealt hand for each Player and for the Banker;

(d) determining which dealt hand is assigned to each Player and which dealt hand is assigned to the Banker;

(e) from their own seven-card dealt hand, each Player and the Banker selecting and keeping their own best 5-card poker hand and discarding two other cards;

(f) determining whether each Player's Pair Of Aces Or Better Bet wager wins or loses; wherein a Player's Pair Of Aces Or Better Bet wager wins if the Player is dealt a 7 Card 9 High hand or a 7 Card Straight Flush hand, or if the Player's hand is a pair of Aces, Two Pair, 3 of a Kind, Straight, Flush, Full House, 4 of a Kind, Straight Flush, Royal Flush or 5 Aces; and the Player's wager loses if the Player is not dealt a 7 Card 9 High hand or a 7 Card Straight Flush hand, and the Player's hand is a pair of Kings or lower; and the player's winning wager may be paid according to either a predetermined pay table or a predetermined payoff odds; and (g) settling each Player's wager against the Banker.

20. A method of playing a card game among a plurality of Players and a Banker, each Player wagering against the Banker, comprising the steps of:

(a) providing and shuffling at least one standard poker deck of 52 cards plus at least one Joker, wherein the Joker may be used as an Ace or to complete a Straight or Flush;

(b) placing a Bonus Bet wager;

(c) dealing cards, seven cards dealt either at one time or proportionally, into enough dealt hands of seven cards to provide a dealt hand for each Player and for the Banker;

(d) determining which dealt hand is assigned to each Player and which dealt hand is assigned to the Banker;

(e) from their own seven-card dealt hand, each Player and the Banker selecting and keeping their own best 5-card poker hand and discarding two other cards;

(f) determining whether each Player's Bonus Bet wager wins, loses, or ties, wherein a Player's Bonus Bet wager wins if the Player is dealt a 7 Card 9 High hand or a 7 Card Straight Flush hand, or if the Player's best 5-card poker hand ranks the same as or ranks higher than the Banker's with a predetermined rank or better; the Player's Bonus Bet wager is a push and neither wins nor loses if the Player is not dealt a 7 Card 9 High hand or a 7 Card Straight Flush hand, and the Player's best 5-card poker hand ranks lower than the Banker's with the predetermined rank or better; and the Player's Bonus Bet wager loses if the Player is not dealt a 7 Card 9 High hand or a 7 Card Straight Flush hand, and the Player's best 5-card poker hand is not a predetermined rank or better; and the Player's winning Bonus Bet wager may be paid according to either a predetermined payoff odds or a predetermined pay table; and (g) settling each Player's wager against the Banker.

* * * * *